US009624650B2

(12) United States Patent
Stratton

(10) Patent No.: US 9,624,650 B2
(45) Date of Patent: Apr. 18, 2017

(54) SYSTEM AND METHOD FOR IMPLEMENT CONTROL

(71) Applicant: Caterpillar Inc., Peoria, IL (US)

(72) Inventor: Kenneth L. Stratton, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 162 days.

(21) Appl. No.: 14/704,401

(22) Filed: May 5, 2015

(65) Prior Publication Data

US 2016/0326725 A1 Nov. 10, 2016

(51) Int. Cl.
*E02F 9/26* (2006.01)
*E02F 3/76* (2006.01)

(52) U.S. Cl.
CPC ..... *E02F 9/265* (2013.01); *E02F 3/7618* (2013.01)

(58) Field of Classification Search
CPC ..... E02F 3/76; E02F 3/7609; E02F 3/7618; E02F 3/84; E02F 3/844; E02F 9/26; E02F 9/265
USPC ..... 172/5, 233, 779
See application file for complete search history.

(56) References Cited

U.S. PATENT DOCUMENTS 3,762,481 A 10/1973 Allen et al.
3,853,181 A 12/1974 Yoshizaki
5,019,983 A * 5/1991 Schutten ..... A01B 69/008 56/10.2 F
5,509,486 A * 4/1996 Anderson ..... A01D 41/1278 172/5
5,860,480 A * 1/1999 Jayaraman ..... E02F 3/845 172/2
6,082,466 A * 7/2000 Gudat ..... A01B 69/008 172/5
6,661,524 B2 * 12/2003 Smith ..... F41H 11/24 356/3.01
8,406,963 B2 * 3/2013 Farmer ..... E02F 3/845 172/10
8,412,418 B2 * 4/2013 Kumagai ..... E02F 3/7618 382/154
8,634,991 B2 * 1/2014 Douglas ..... E02F 3/847 172/4.5
9,234,329 B2 * 1/2016 Jaliwala ..... E02F 9/2041
2013/0092405 A1 4/2013 Hall

* cited by examiner

*Primary Examiner* — Gary Hartmann

(57) ABSTRACT

A system associated with an implement of a machine is provided. The system includes a ground speed detection module configured to generate a signal indicative of a ground speed of the machine. The system further includes an implement control module coupled to the ground speed detection module. The implement control module receives the signal indicative of the ground speed of the machine. The implement control module detects at least one of the ground speed of the machine being less than a predetermined speed threshold and a rate of change of the ground speed being above a limit. The implement control module determines a presence of an obstruction in a path of the machine based, at least in part, on the detection. The implement control module further select a movement from a plurality of movements associated with the implement and triggers the movement of the implement.

20 Claims, 5 Drawing Sheets

SYSTEM AND METHOD FOR IMPLEMENT CONTROL

TECHNICAL FIELD

The present disclosure relates to an automated machine control, and more particularly to a system and method for automatically controlling an implement of a machine.

BACKGROUND

In conventional large bulldozers used for conducting digging operations, a blade is mounted on a front portion of the machine for performing tasks. The blade is operated through lifting and tilting hydraulic cylinders. In some configurations, the tilting hydraulic cylinders selectively tilt or pitch the blade.

To operate at maximum efficiency, the bulldozer is usually operated near a traction limit associated with the bulldozer. However, sometimes during operation of the machine, obstructions such as rocks, boulders, or pile of material may lie in a path of traversal of the machine. These obstructions may cause the bulldozer to exceed the traction limit and to slip and stall or cause the bulldozer to get stuck in the ground, and may further prevent the machine from progressing on the path of traversal.

In such situations, especially in the case of automated dozing, an operator of the machine may need to intervene in order to allow the machine to get back to regular operation. This intervention is usually accomplished by initially attempting to raise the blade using the lifting hydraulic cylinders. Such actions may be difficult to perform given the obstructed state of the blade. Accordingly, this may affect an overall efficiency of the system. Also, in such situations, there is an increase in reliance on the operator for intervention.

U.S. Published Application 2013/0092405 describes a vehicle ripping mechanism. The mechanism has a ripping unit including an engagement head supported on a support frame about a ripping unit pivot axis. A vibrator mechanism is mounted to the ripping unit. Activation of the vibrator mechanism causes reciprocating pivoting movement of the ripping unit. A tilt adjustment hydraulic cylinder is connected to the frame that is adjustable in length to alter orientation of the ripping unit. A control system includes a pressure sensor connected to the cylinder. The system deactivates the vibrator mechanism based on pressure sensed by the sensor.

SUMMARY OF THE DISCLOSURE

In one aspect of the present disclosure, a system associated with an implement of a machine is provided. The system includes a ground speed detection module configured to generate a signal indicative of a ground speed of the machine. The system further includes an implement control module coupled to the ground speed detection module. The implement control module receives the signal indicative of the ground speed of the machine. The implement control module detects at least one of the ground speed of the machine being less than a predetermined speed threshold and a rate of change of the ground speed being above a limit. The implement control module determines a presence of an obstruction in a path of the machine based, at least in part, on the detection. The implement control module further selects a movement from a plurality of movements associated with the implement based on the determination. The implement control module further triggers the movement of the implement based on the selection.

In another aspect of the present disclosure, a method for automatically controlling an implement of a machine is provided. The method includes receiving a signal indicative of a ground speed of the machine. The method further includes detecting if at least one of the ground speed of the machine is being less than a predetermined speed threshold and a rate of change of the ground speed being above a limit. The method also includes determining a presence of an obstruction in a path of the machine based, at least in part, on the detection. The method further includes selecting a movement from a plurality of movements associated with the implement based on the determination. The method further includes triggering the movement of the implement based on the selection.

In yet another aspect of the present disclosure, a machine is provided. The machine includes an engine. The machine also includes an implement. The machine further includes a ground speed detection module configured to generate a signal indicative of a ground speed of the machine. The machine further includes an implement control module coupled to the ground speed detection module. The implement control module receives the signal indicative of the ground speed of the machine. The implement control module detects at least one of the ground speed of the machine being less than a predetermined speed threshold and a rate of change of the ground speed being above a limit. The implement control module determines a presence of an obstruction in a path of the machine based, at least in part, on the detection. The implement control module further selects a movement from a plurality of movements associated with the implement based on the determination. The implement control module further triggers the movement of the implement based on the selection.

Other features and aspects of this disclosure will be apparent from the following description and the accompanying drawings.

DETAILED DESCRIPTION

Figure 1:
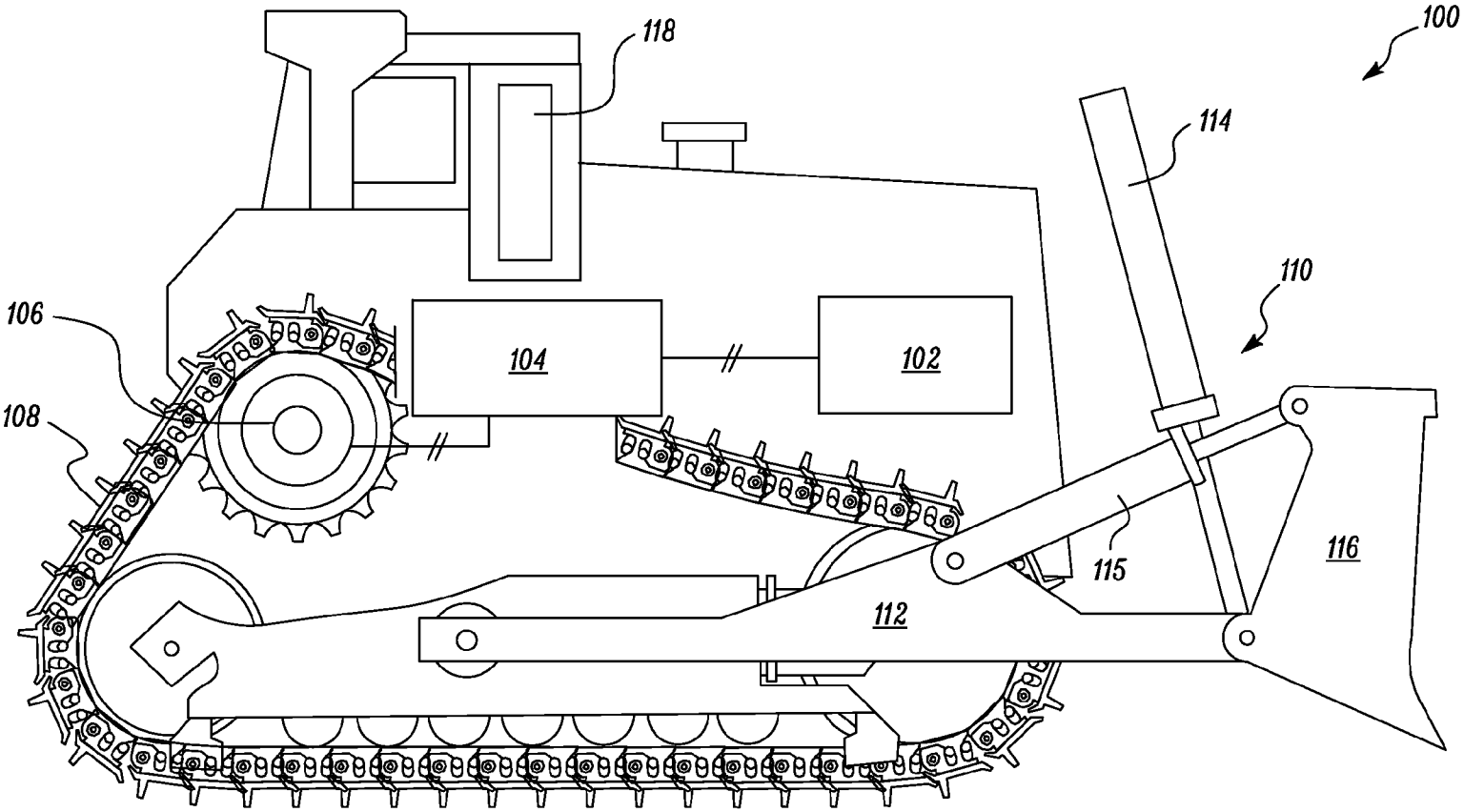
FIG. 1 is a side view of an exemplary machine, according to one embodiment of the present disclosure.

Wherever possible, the same reference numbers will be used throughout the drawings to refer to the same or the like parts. FIG. 1 illustrates an exemplary machine 100. The machine 100 is embodied as an automated dozer. Alternatively, the machine 100 may be semi-automated or completely manual. It should be understood that the machine 100 may alternatively include any other track type machine used in various industries.

As illustrated in FIG. 1, the machine 100 may include a power source 102, a transmission system 104, and a propulsion system 106. In one embodiment, the power source 102 may include, for example, a diesel engine, a gasoline engine, a gaseous fuel powered engine such as a natural gas engine, a combination of known sources of power or any other type of engine apparent to one of skill in the art. The transmission system 104 may be communicably coupled to the power source 102. The transmission system 104 may include coupling elements for transmitting a drive torque from the power source 102 to the propulsion system 106. As illustrated in FIG. 1, the propulsion system 106 may include a track 108 having ground engaging elements configured to propel the machine 100.

Further, the machine 100 may include a load lifting assembly 110 having a lift arm 112, one or more lifting cylinders 114, one or more tilt cylinders 115, and an implement 116, such as a blade or bucket. The implement 116 is configured to push, dig, collect, hold and convey material and/or heavy objects. The lifting cylinders 114 may be configured to effectuate the movement of the lifting assembly 110 based on an operator command provided by an operator of the machine 100. The tilt cylinder 115 may be configured to change an insertion angle of an included angle of the implement 116. The operator command may be received through various input devices present within an operator cabin 118 of the machine 100.

Digging, soil pushing, and levelling of ground mingled with hard rocks is performed using the implement 116 of the machine 100. During operation of the machine 100, an insertion depth and the insertion angle of the implement 116 is controlled by operating the lifting cylinders 114 associated with the implement 116. Further, movements associated with the implement 116, for example, pitch, yaw and roll of the blade of the machine 100 may also be controlled by the lifting cylinders 114 and/or the tilt cylinders 115.

The present disclosure provides an automatic implement control system 200 for controlling an operation of the implement 116 when the machine 100 is obstructed from traversing. In an embodiment, the automatic implement control system 200 is on board the machine 100. Alternatively, the automatic implement control system 200 may be located at a remote site.

Figure 2:
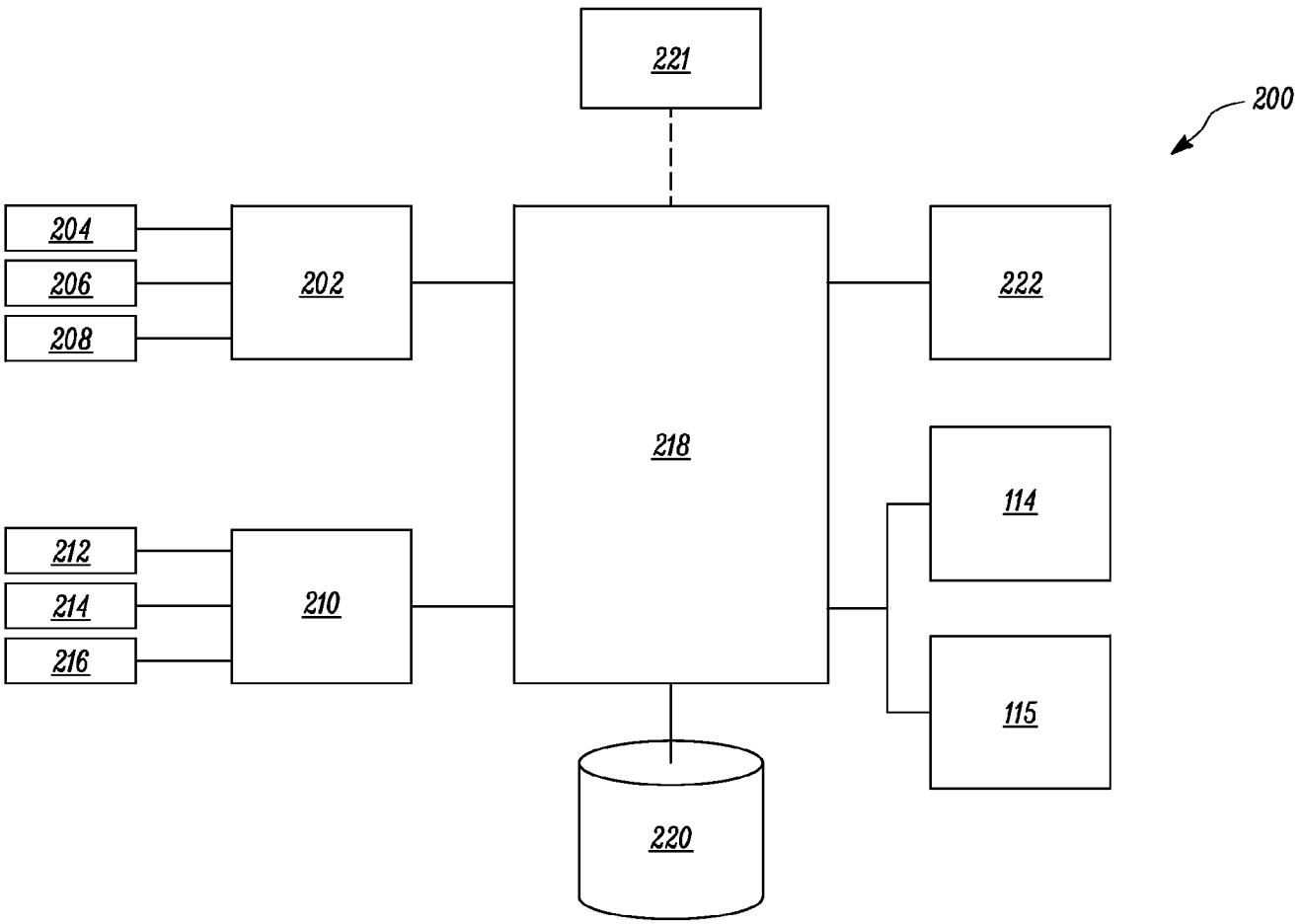
FIG. 2 is a block diagram of an implement control system associated with the machine of FIG. 1, according to one embodiment of the present disclosure.

Referring to FIG. 2, the automatic implement control system 200 includes a ground speed detection module 202. The ground speed detection module 202 is configured to monitor a ground speed of the machine 100. The ground speed detection module 202 may either generate the signal indicative of the ground speed of the machine 100 or may compute or derive the ground speed based on other measured signals associated with the machine 100. For example, the ground speed detection module 202 may include a ground speed sensor 204, a gear transmission sensor 206, an implement position sensor 208, or a combination thereof. In alternative embodiments, the ground speed of the machine 100 may be measured with a Doppler radar, a Doppler shift on a GPS signal, differential position measurements, or visual perception etc.

Additionally or optionally, the automatic implement control system 200 includes a tractive force monitoring module 210. The tractive force monitoring module 210 is configured to monitor tractive forces developed by the machine 100. During operation, the machine 100 moves about the worksite and attains a certain ground speed and also generates certain tractive forces so as to utilize the implement 116 for achieving the desired operation. In one embodiment, the tractive force monitoring module 210 is configured to generate a signal indicative of a torque associated with the implement 116. The tractive force monitoring module 210 may either generate the signal indicative of the tractive force generated by the machine 100 or may compute or derive the tractive force based on other measured signals associated with the machine 100. For example, the tractive force monitoring module 210 may include an engine speed sensor 212, a transmission output speed sensor 214, an implement torque sensor 216, or a combination thereof.

The automatic implement control system 200 also includes an implement control module 218 in communication with the ground speed detection module 202 and the tractive force monitoring module 210. The implement control module 218 is configured to select a movement from a number of movements and trigger the movement of the implement 116 of the machine 100 based on the selection. The number of movements may include, for example, the pitch, the yaw, the roll, or a combination thereof. Accordingly, the implement control module 218 receives the signal indicative of the ground speed of the machine 100. The implement control module 218 is further configured to compare the ground speed with a predetermined speed threshold or compare a rate of change of the ground speed with a limit. As shown in FIG. 2, the implement control module 218 is coupled to a database 220. The database 220 may include any known data repository from which data can be queried, stored, or retrieved. The predetermined speed threshold and/or the limit may be stored in the database 220 and retrieved therefrom by the implement control module 218.

In one embodiment, the implement control module 218 may receive the signal indicative of the tractive force from the tractive force monitoring module 210. The implement control module 218 may then retrieve a predetermined threshold associated with the tractive force from the database 220, and compare the tractive force with the predetermined threshold.

Further, the implement control module 218 is configured to determine a presence on an obstruction in a path of the machine 100 if the ground speed of the machine 100 is less than a predetermined speed threshold, the rate of change of the ground speed is above a limit, or tractive force is greater than the predetermined threshold. The implement control module 218 is coupled to the lifting or tilt cylinders 114, 115. If the presence of the obstruction is detected, the implement control module 218 selects and triggers the movement of the implement 116 by sending appropriate command signals to the lifting or tilt cylinders 114, 115. The movement of the implement 116 may include rocking of the blade fore and aft to attempt to roll the obstruction off the ground. For example, the implement control module 218 may send signals to control the lift, pitch or roll of the implement 116.

In order to achieve the rocking of the blade, the implement control module 218 may estimate the blade pitch. The blade pitch may be estimated in a variety of ways. In one embodiment, the blade pitch may be estimated based on a hydraulic model for monitoring flow of a hydraulic fluid into the lifting or tilt cylinders 114, 115. In another embodiment, a stroke sensor may be used for measuring stroke associated with the lifting or tilt cylinders 114, 115 in order to estimate the blade pitch. The stroke sensor may include a magneto restrictive sensor, a bar code sensor, a roller sensor, etc. In yet another embodiment, a perception sensor, such as, binocular or monocular vision sensors, 3D lasers, Flash LIDAR, etc. may be used to estimate the blade pitch. The working of the implement control module 218 will be described in detail in connection with FIGS. 3 and 4.

In one embodiment, a perception module 221 may optionally coupled to the implement control module 218. The perception module 221 may be configured to determine a tendency of the machine 100 hitting the obstruction based on an effective density of rocks on the worksite. The effective density of the rocks is based on the size of rocks, the number of rocks in a projected dozing path or a combination of size and number of rocks. The effective density of the rocks may also be a non-linear relationship with larger rocks having a larger impact on the effective density of the rocks. The perception module 221 may receive a signal indicative of the effective density of rocks in a volume of material projected to be moved by the implement 116 of the machine 100. If the tendency of hitting the obstruction is estimated to be high based on the received signal, the perception module 221 may appropriately adjust the predetermined speed threshold or the limit or both. The adjustment may include increasing or decreasing predetermined speed threshold or the limit as the case may be. The perception module 221 may include a visual processing system, a radar detection system, a seismic detection system, or a combination.

In another embodiment, the implement control module 218 is coupled to an output module 222. The output module 222 may include a display unit such as a screen, a monitor, an LCD, or any other display panel. The output module 222 may be present in the operator cabin 118, or may be provided remote from the machine 100. The output module 222 may be configured to notify the operator of the presence of the obstruction or the movement of the implement 116 based on a suitable visual notification. Alternatively, the output module 222 may provide an audio message for notifying the operator.

Further, in one embodiment, the implement control module 218 may be activated manually based on a mode selection by the operator. For example, the mode may be selected by an ON/OFF switch present in the operator cabin 118. The operator may select an ON mode for autonomous operation of the machine 100, and an OFF mode for a semi-automated operation of the machine 100.

Figure 3:
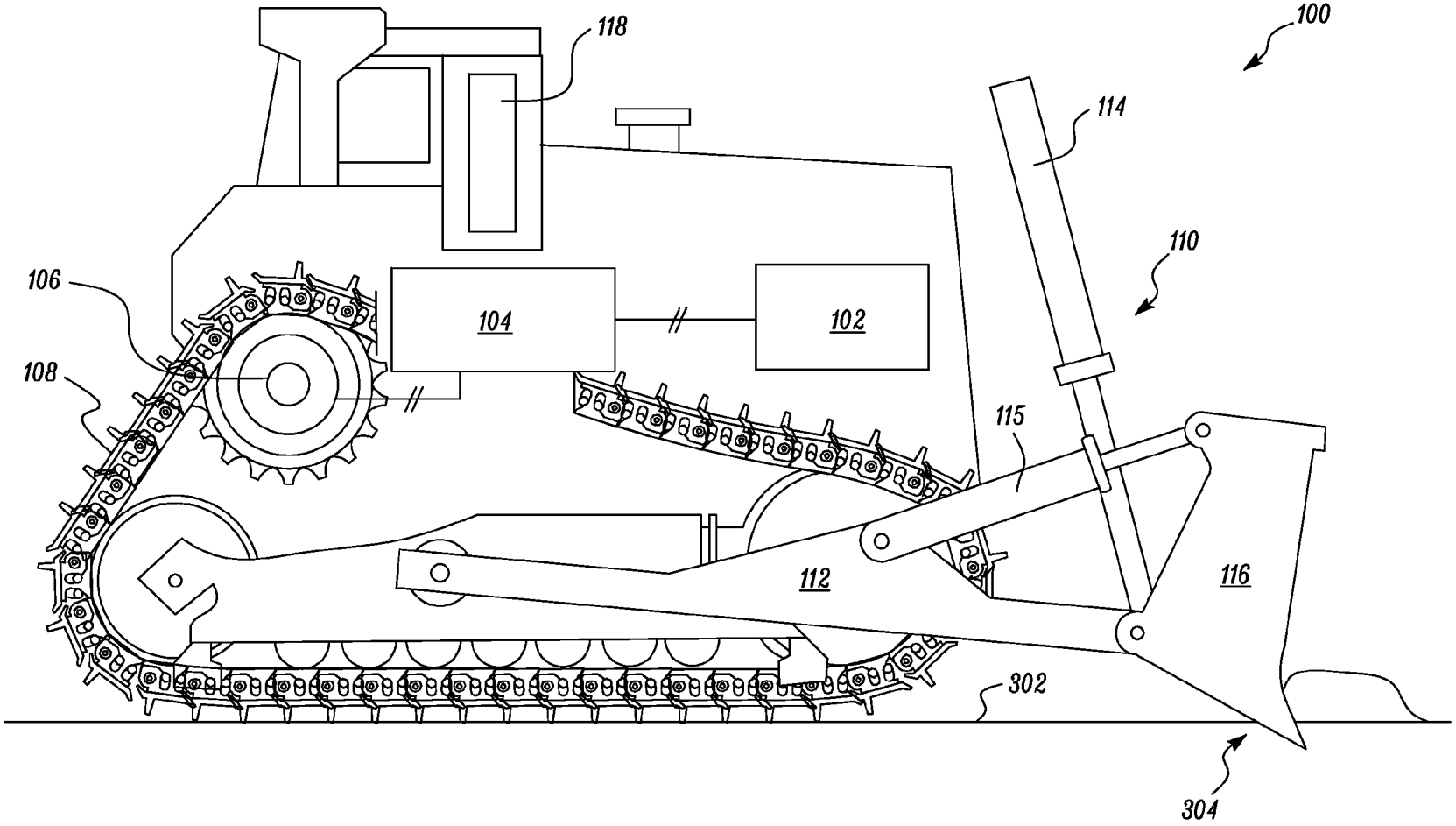
FIG. 3 is a another side view of the machine of FIG. 1 when obstructed, according to one embodiment of the present disclosure.

Referring to FIG. 3, an exemplary situation is illustrated. During operation of the machine 100, the obstruction in the path of the machine 100 may cause the implement 116 to get stuck in the ground 302. In this case, the ground speed of the machine 100 falls below the predetermined speed threshold. Alternatively or additionally, on contacting the obstruction, the ground speed may change or decrease dramatically, causing the rate of change of the ground speed to exceed the limit. Alternatively or additionally, the tractive force of the machine 100 may increase above the predetermined threshold. Accordingly, the implement control module 218 detects the presence of the obstruction in the path of the machine 100.

Figure 4:
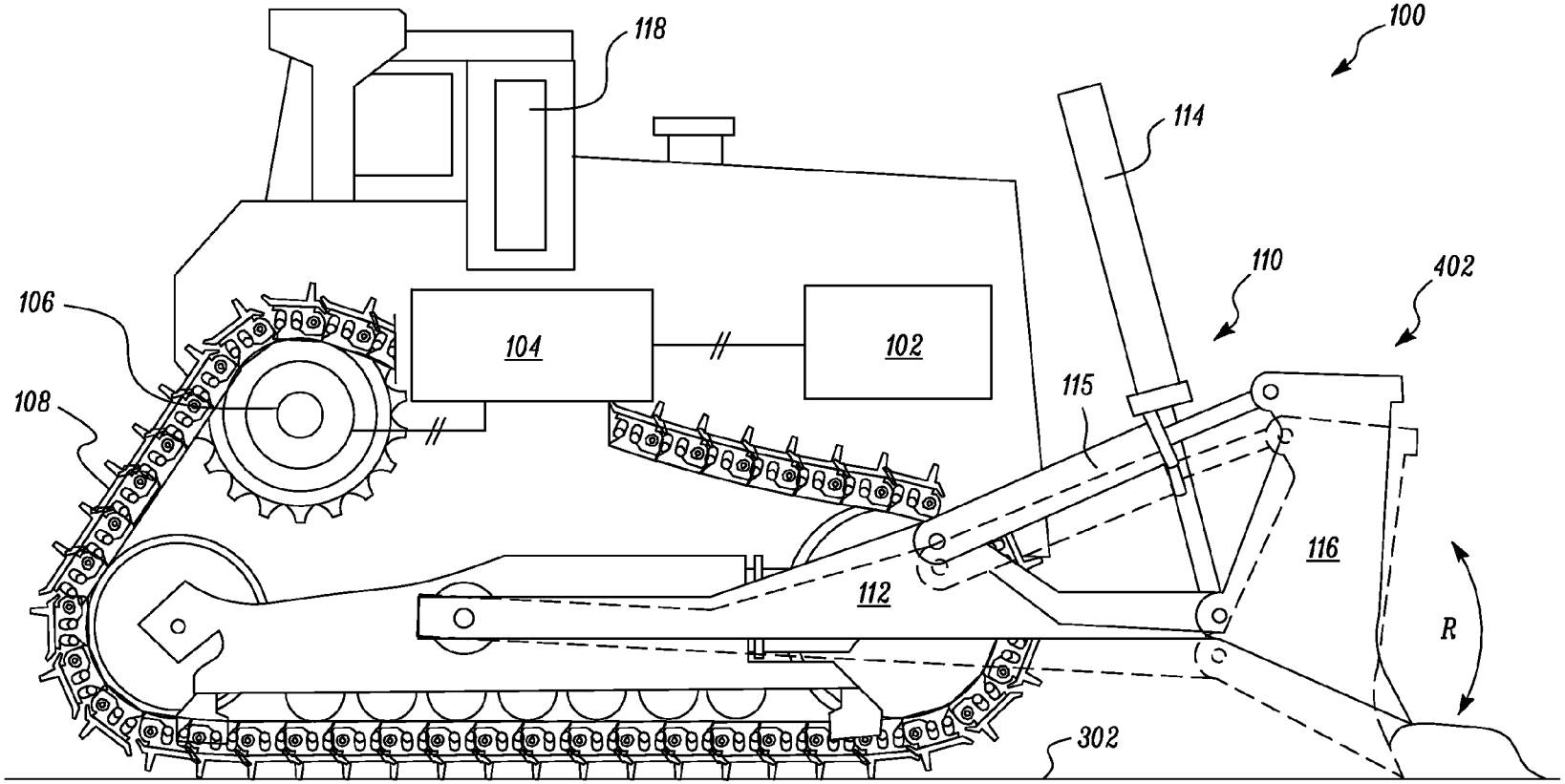
FIG. 4 is yet another side view of the machine of FIG. 1 under automatic operation, according to one embodiment of the present disclosure.

Further, referring to FIG. 4, based on the detection of the presence of the obstruction, the implement control module 218 selects and triggers the movement of the implement 116. As shown, in this exemplary situation, the implement control module 218 send command signals to the lifting or tilt cylinders 114, 115 to cause a rocking motion (denoted by arrow "R"). The movement of the implement 116 may enable the machine 100 to attain the released position 402 (FIG. 4) from the stuck position 304.

The ground speed detection module 202, the tractive force monitoring module 210, and/or the implement control module 218 may embody a single microprocessor or multiple microprocessors that includes a means for receiving signals from the power source 102, the transmission system 104, the propulsion system 106, and the database 220. Numerous commercially available microprocessors may be configured to perform the functions associated with the modules. It should be appreciated that the modules may readily embody a general machine microprocessor capable of controlling numerous machine functions. A person of ordinary skill in the art will appreciate that the modules may additionally include other components and may also perform other functionality not described herein. It should be understood that the embodiments and the configurations and connections explained herein are merely on an exemplary basis and may not limit the scope and spirit of the disclosure.

INDUSTRIAL APPLICABILITY

Figure 5:
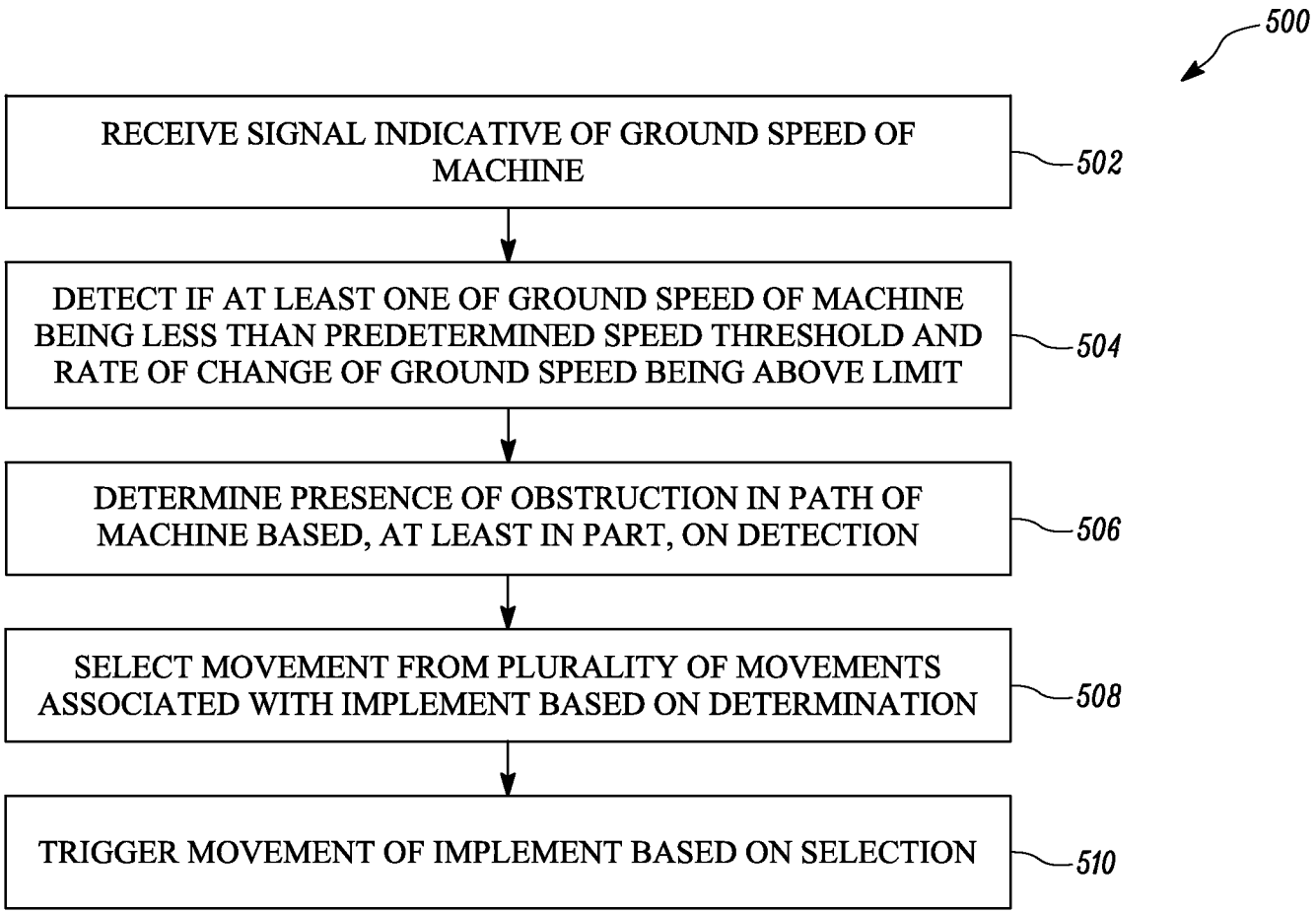
FIG. 5 is a flow chart of a method for automatically controlling an implement of the machine of FIG. 1, according to one embodiment of the present disclosure.

The present disclosure describes the automatic implement control system 200 associated with the implement 116 of the machine 100, industrial applicability of the automatic implement control system 200 will be described with reference to a method 500 of FIG. 5 which will be readily appreciated from the foregoing discussion.

The method 500 automatically controls the implement 116 of the machine 100. At step 502, the signal indicative of the ground speed of the machine 100 is received by the implement control module 218. The signal indicative of the ground speed of the machine 100 is monitored and provided by the ground speed detection module 202 in communication with the implement control module 218.

At step 504, the implement control module 218 detects if the ground speed of the machine 100 is less than the predetermined speed threshold. Alternatively or additionally, the implement control module 218 detects if the rate of change of the ground speed is above the limit. Alternatively or additionally, the implement control module 218 receives the signal indicative of the tractive force of the machine 100. The implement control module 218 further compares the tractive force with the predetermined threshold.

At step 506, the implement control module 218 determines presence of the obstruction in the path of the machine 100. As described earlier, the determination of the presence of the obstruction is done if the ground speed is detected to be lower than the predetermined speed threshold, the rate of change of the ground speed is detected to be above the limit, and/or the tractive force is detected to be greater than the predetermined threshold. At step 508, the implement control module 218 selects a movement from the number of movements associated with the implement 116 based on the determination of the obstruction. The number of movements may include, for example, the pitch, the yaw, the roll, or a combination thereof. At step 510, the implement control module 218 triggers the movement of the implement 116 based on the selection of the movement. The movement of the implement 116 may include controlling the yaw, pitch, rocking to and fro, etc. of the implement 116.

The automatic implement control system 200 employed by the machine 100 automatically controls the movement of the implement 116 when the machine 100 is obstructed or is in the stuck position 304. The movement of the implement 116 enables the machine 100 to achieve the released position 402. The automatic implement control system 200 thus adds a non-intuitive behavior of the operator of the machine 100, without any intervention of the operator. Accordingly, the automatic implement control system 200 enables operation of the machine 100 with minimal human involvement. This provides less fatigue to the operator, and further helps in increasing overall efficiency and productivity of work operations.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system associated with an implement of a machine, the system comprising:

a ground speed detection module configured to generate a signal indicative of a ground speed of the machine; and an implement control module coupled to the ground speed detection module, the implement control module configured to:

receive the signal indicative of the ground speed of the machine;

detect at least one of the ground speed of the machine being less than a predetermined speed threshold and a rate of change of the ground speed being above a limit;

determine a presence of an obstruction in a path of the machine based, at least in part, on the detection; and select a movement from a plurality of movements associated with the implement based on the determination; and trigger the movement of the implement based on the selection.

2. The system of claim 1 further comprising a tractive force monitoring module configured to generate a signal indicative of a tractive force generated by the machine.

3. The system of claim 2, wherein the implement control module is further configured to:

receive the signal indicative of the tractive force of the machine;

compare the tractive force with a predetermined threshold;

detect if the tractive force is greater than the predetermined threshold; and determine the presence of the obstruction based on the detection.

4. The system of claim 2, wherein the tractive force monitoring module is further configured to generate a signal indicative of a torque associated with the implement.

5. The system of claim 2, wherein the tractive force monitoring module receives an input from at least one of an engine speed sensor, a transmission output speed sensor, an implement torque sensor, or a combination thereof.

6. The system of claim 1, wherein the ground speed detection module receives an input from at least one of a ground speed sensor, a gear transmission sensor, an implement position sensor, or a combination thereof.

7. The system of claim 1, wherein the implement control module is activated manually based on a mode selection.

8. The system of claim 1, wherein the plurality of movements includes controlling at least one of a pitch, a yaw, or a combination thereof of a blade of the machine.

9. The system of claim 1 further comprising an output module coupled to the implement control module.

10. The system of claim 9, wherein the implement control module is configured to notify an operator of the presence of the obstruction based on the determination.

11. The system of claim 1 further comprising a perception module coupled to the implement control module.

12. The system of claim 11, wherein the perception module is further configured to:

receive a signal indicative of an effective density of rocks in a volume of material projected to be moved by the implement of the machine;

determine a tendency of the machine to be obstructed based on the received signal; and adjust at least one of the predetermined speed threshold and the limit based on the tendency.

13. A method for automatically controlling an implement of a machine, the method comprising:

receiving a signal indicative of a ground speed of the machine;

detecting at least one of the ground speed of the machine being less than a predetermined speed threshold and a rate of change of the ground speed being above a limit;

determining a presence of an obstruction in a path of the machine based, at least in part, on the detection;

selecting a movement from a plurality of movements associated with the implement based on the determination; and triggering the movement of the implement based on the selection.

14. The method of claim 13 further comprising:

receiving a signal indicative of a tractive force of the machine;

comparing the tractive force with a predetermined threshold;

detecting if the tractive force is greater than the predetermined threshold; and determining the presence of the obstruction based on the detection.

15. The method of claim 13, wherein the plurality of movements includes controlling at least one of a pitch, a yaw, or a combination thereof of a blade of the machine.

16. The method of claim 13 further comprising:

receiving a signal indicative of a density of rocks in a volume of material projected to be moved by the implement of the machine;

determining a tendency of the machine to be obstructed based on the received signal; and adjusting at least one of the predetermined speed threshold and the limit based on the tendency.

17. A machine comprising:

an engine;

an implement;

a ground speed detection module configured to generate a signal indicative of a ground speed of the machine; and an implement control module coupled to the ground speed detection module, the implement control module configured to:

receive the signal indicative of the ground speed of the machine;

detect at least one of the ground speed of the machine being less than a predetermined speed threshold and a rate of change of the ground speed being above a limit;

determine a presence of an obstruction in a path of the machine based, at least in part, on the detection; and select a movement from a plurality of movements associated with the implement based on the determination; and trigger the movement of the implement based on the selection.

18. The machine of claim 17 further comprising a tractive force monitoring module is further configured to generate a signal indicative of a tractive force generated by the machine.

19. The machine of claim 18, wherein the implement control module is further configured to:

receive the signal indicative of the tractive force of the machine;

compare the tractive force with a predetermined threshold;

detect if the tractive force is greater than the predetermined threshold; and determine the presence of the obstruction based on the detection.

20. The machine of claim 17 further comprising an output module coupled to the implement control module.

* * * * *